US009288564B2

(12) United States Patent
Faerstain et al.

(10) Patent No.: US 9,288,564 B2
(45) Date of Patent: Mar. 15, 2016

(54) INTEGRATED AUDIO-VISUAL SYSTEMS

(71) Applicants: Norbert Faerstain, Tarzana, CA (US); Michael Kern, Cypress, CA (US); James Hurrell, Castaic, CA (US)

(72) Inventors: Norbert Faerstain, Tarzana, CA (US); Michael Kern, Cypress, CA (US); James Hurrell, Castaic, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 428 days.

(21) Appl. No.: 13/736,821

(22) Filed: Jan. 8, 2013

(65) Prior Publication Data

US 2014/0193016 A1 Jul. 10, 2014

(51) Int. Cl.

| | |
|---|---|
| ***H04R 1/02*** | (2006.01) |
| ***H04R 9/06*** | (2006.01) |
| ***H04R 7/04*** | (2006.01) |

(52) U.S. Cl.

CPC ..... *H04R 1/028* (2013.01); *H04R 7/045* (2013.01); *H04R 2440/05* (2013.01); *H04R 2440/07* (2013.01); *H04R 2499/15* (2013.01)

(58) Field of Classification Search

CPC ..... H04R 5/02

USPC ..... 381/190, 333

See application file for complete search history.

(56) References Cited

U.S. PATENT DOCUMENTS

| | | | | |
|---|---|---|---|---|
| 5,025,474 | A * | 6/1991 | Tanaka | G03B 21/565 181/148 |
| 2004/0240687 | A1* | 12/2004 | Graetz | 381/152 |
| 2006/0274283 | A1* | 12/2006 | Lin et al. | 353/74 |
| 2013/0120351 | A1* | 5/2013 | Yoon et al. | 345/212 |
| 2013/0301856 | A1* | 11/2013 | Kim et al. | 381/190 |

* cited by examiner

*Primary Examiner* — Simon King

(74) *Attorney, Agent, or Firm* — Sheppard Mullin Richter & Hampton LLP

(57) ABSTRACT

Integrated audio-visual systems are provided. Such integrated audio-visual systems are capable of reproducing sound frequencies without compromising visual characteristics. In particular, a surface of the acoustic diaphragm also serves as the image projection screen. Such surface may be made of materials capable of reflecting light and converting audio signals simultaneously. The surface may be integrated with electromagnetic conductive materials or nanomaterials. In response to an audio signal, the surface is driven by various driving mechanism to create acoustic vibration. Any number of audio zones may be created on the surface and the audio emanation areas may be customized for the desired application.

17 Claims, 4 Drawing Sheets

INTEGRATED AUDIO-VISUAL SYSTEMS

TECHNICAL FIELD

The present application relates generally to speaker systems and projection screens, and more particularly, some embodiments relate to integrated audio-visual systems.

DESCRIPTION OF THE RELATED ART

Current audio-visual systems demand a system that enables one to enjoy images projected on a large screen with powerful, accurate, and realistic sound. Often, one or more speakers are disposed behind the screen. The screen is therefore interposed between the speaker and the listener. This impairs the acoustic characteristics of the speaker(s). The screen may be perforated so that sound waves can penetrate the screen to reach the audience. However, sounds lose fidelity because much of the audio is still blocked by the material. Furthermore, the perforated screen can cause visible interference patterns such as Moire patterns. Additionally, perforation of the screen causes light reflection loss or inefficiency, which can be as high as 20-30%. As a result, the brightness of the image on the screen is inevitably lower than a non-perforated screen or a screen designed to optimize light return without having to compromise such light return for acoustic transparency. The use of perforated screens can also create a noticeable grid pattern or "screen door" effect in the projected image.

BRIEF SUMMARY

Integrated audio-visual systems are described. In particular, an integrated audio-visual surface is provided. The integrated audio-visual system is capable of accurately reproducing sound frequencies without compromising visual characteristics. A surface of the acoustic diaphragm may be treated such that it may also serve as the image projection screen. Various embodiments provide a large image projection screen that may be used in theatres or location-based venues. As a result of this design, sound fidelity is improved due to the placement of the audio source(s) on the projection screen surface.

Embodiments of the disclosure provide a surface that serves both as an acoustic diaphragm and as an image projection screen. The surface is made of a material capable of simultaneously reflecting light and producing sounds. The surface may be non-perforated, lower in mass, significantly thinner, and more efficient compared to the conventional image projection surfaces. In some embodiments, the surface is made of electromagnetic conductive materials. In one embodiment, the surface is a membrane having integrated voice coil circuits. In one embodiment, the surface may be made of nanomaterials such as graphene or carbon nanotubes. In response to an audio signal, the surface is driven by various driving mechanisms to create acoustic vibration. The surface may be divided into isolated audio zones. Any number of audio zones may be configured on the surface and the audio emanation areas may be customized for the desired application.

In some embodiments, an integrated audio-visual system comprises an acoustic diaphragm configured to vibrate in response to an audio signal, an input terminal coupled to the acoustic diaphragm, and a frame. The acoustic diaphragm has a first surface and a second surface, with the first surface serving as an image projection screen. The input terminal is configured to receive the audio signal. The frame is provided on the second surface of the acoustic diaphragm, and defines an air gap exposed to a portion of the second surface of the acoustic diaphragm.

In one embodiment, an acoustic diaphragm may comprise a voice coil layer comprising a plurality of voice coils, a first layer and a second layer. The first layer is formed on a first side of the plurality of voice coils. The second layer is formed on a second side of the plurality of voice coils. The plurality of voice coils are sandwiched between the first and second layers. A surface of a first layer serves as an image projection screen. In further embodiments, a membrane with woven voice coils may be coated or treated to reflect light.

Other features and aspects of the application will become apparent from the following detailed description, taken in conjunction with the accompanying figures. This summary does not limit the scope of the application, which is defined solely by the claims attached hereto.

BRIEF DESCRIPTION OF THE FIGURES

The present application, in accordance with one or more various embodiments, is described in detail with reference to the following figures. The figures are provided for purposes of illustration only and merely depict typical or example embodiments of the application. These figures are provided to facilitate the reader's understanding of the application and shall not be considered limiting of the breadth, scope, or applicability of the application. It should be noted that for clarity and ease of illustration these figures are not necessarily made to scale.

Some of the figures included herein illustrate various embodiments of the application from different viewing angles. Although the accompanying descriptive text may refer to such views as "top," "bottom" or "side" views, such references are merely descriptive and do not imply or require that the application be implemented or used in a particular spatial orientation unless explicitly stated otherwise.

The figures are not intended to be exhaustive or to limit the application to the precise form disclosed. It should be understood that the application can be practiced with modification and alteration, and that the application be limited only by the claims and the equivalents thereof.

DETAILED DESCRIPTION OF THE EMBODIMENTS OF THE APPLICATION

The present application is directed toward an integrated audio-visual system. The integrated audio-visual surface is capable of reproducing sound frequencies without compromising visual characteristics. In particular, the integrated surface serves as an image projection screen and an acoustic diaphragm. The acoustic diaphragm converts sound signals into acoustic vibrations. In some embodiments, the surface of an acoustic diaphragm may be treated or coated to reflect light. In one embodiment, the surface is a planar surface. In other embodiments, the surface is a non-planar surface or concave or curved surface. In further embodiments, the surface may be treated to retain polarization to display 3-D images.

Some audio-visual systems include a non-perforated surface that serves as an image projection screen capable of producing sound waves. Such systems may reproduce full fidelity sound. One embodiment may reproduce full fidelity sound in the frequency range of 80 Hz and 14 kHz. In various embodiments, the integrated surface may be configured to comprise multiple audio zones or channels. In further embodiments, integrated audio-visual systems may be custom tailored for the desired application. In some embodiments, the entire surface may be active in emanating sound waves. In further embodiments, certain portions of the surface may be active. These systems may improve sound fidelity due to the non-point nature of the audio source. Furthermore, various embodiments provide panels with an integrated audio-visual surface, which may be assembled seamlessly to form a large panel.

Figure 1A:
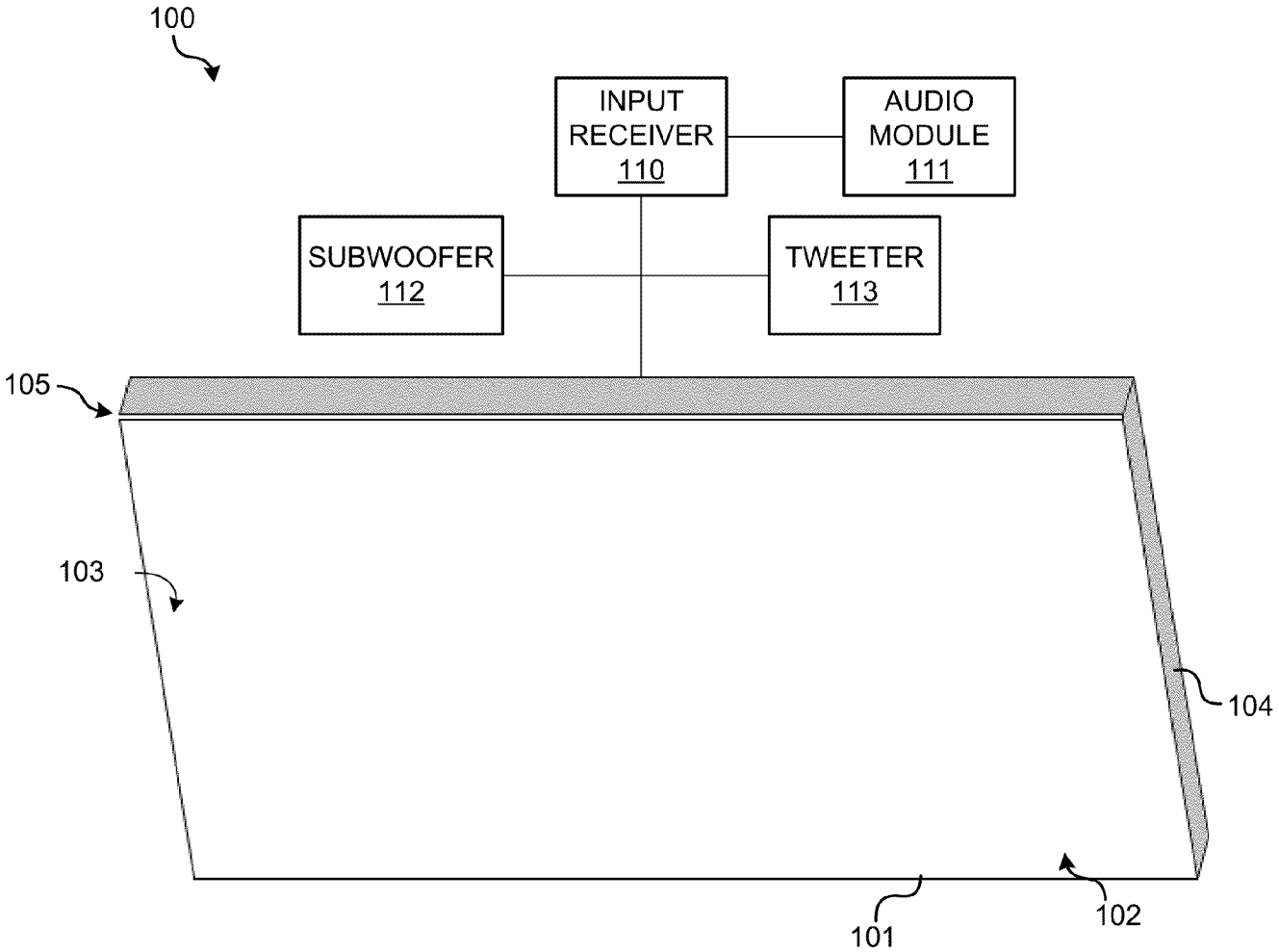
FIG. 1A is a front view of an integrated audio-visual system.
Figure 1B:
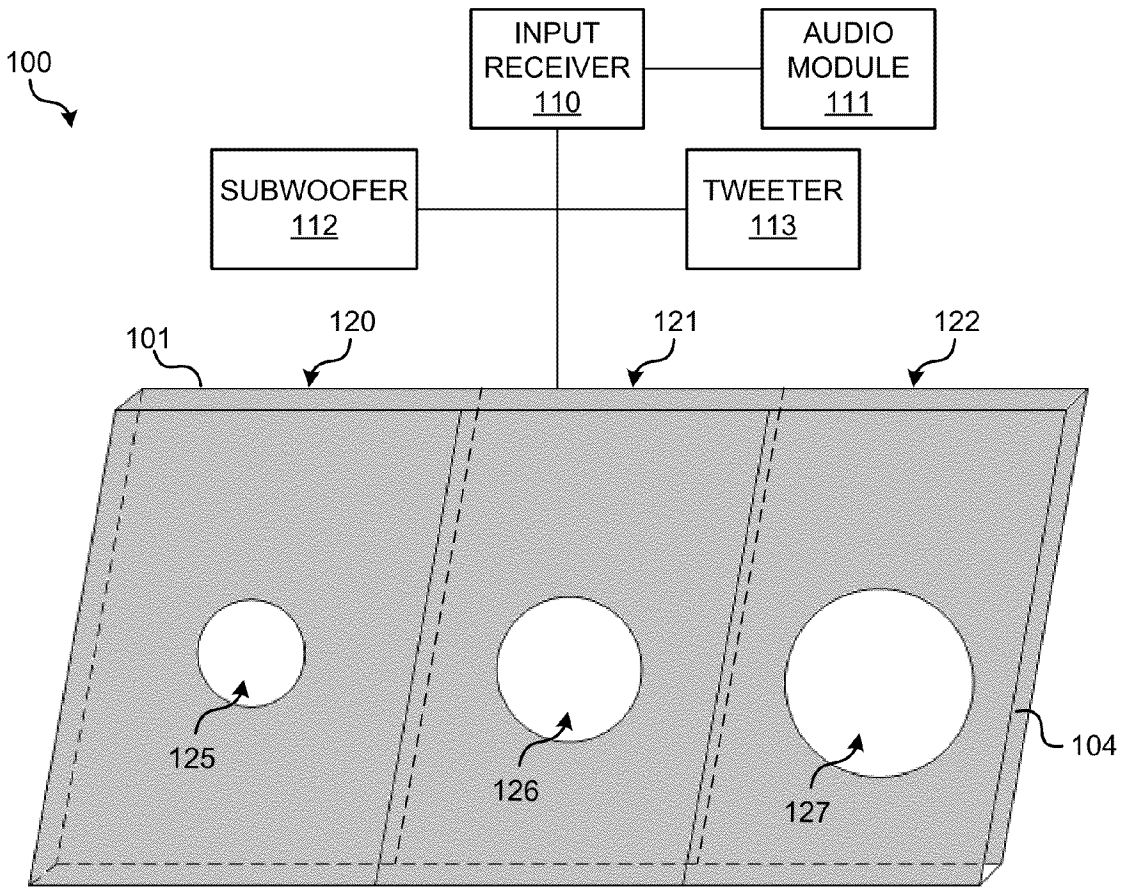
FIG. 1B is a rear view of an integrated audio-visual system.

Referring to FIGS. 1A-1B, an integrated audio-visual system 100 is depicted. FIG. 1A is a front view of the integrated audio-visual system 100. The integrated audio-visual system 100 comprises a diaphragm 101 and a frame 104. The diaphragm 101 has a front surface 102. The surface 102 may be an image projection screen that displays projected images. The surface 102 may be treated or coated to reflect light. In one embodiment, the surface 102 is planar. In other embodiments, the surface 102 may not be entirely planar. For example, some visual performances may require horizontal or vertical arc to optimize light return for some venues. In further embodiments, the surface 102 may be treated with various materials or coatings to maintain polarized light return for use in 3-D image content presentation.

The diaphragm 101 may have a rear surface 103 on which the frame 104 is fixed. The frame 104 may be attached, locked, secured, or mounted to one or more rims of the rear surface 103 of the diaphragm 101. The frame 104 provide support to prevent the diaphragm 101 from free floating. For example, the diaphragm 101 does not move toward or away from the frame 104 freely such that interference among sound waves generated from the diaphragm 101 is minimized. Undesired cancellation or amplification of sound may be eliminated. In various embodiments, the frame 104 and the diaphragm 101 may define an opening 105. The opening 105 allows air surrounding the diaphragm 101 to flow to enable creation of any sound effect. The opening 105 may be adjusted to control the stiffness of the air thereby adjusting the resonance frequency to create various sound at different frequencies. Further, the frame 104 may be made of materials to absorb undesirable sound waves emanated from the rear surface 103 of the diaphragm 101. In the illustrated example, the opening 105 is located on the top rim of the integrated audio-visual system 100. In other embodiments, one or more openings could be employed, with various shapes and at various locations.

The integrated audio-visual system 100 may also comprise an input receiver that is configured to receive audio signals. The input receiver may receive the signal via a communication medium. In various embodiments, the communication medium may be a wired system (such as a coaxial cable system, a fiber optic cable system, an Ethernet cable system) or a wireless network system (such as a wireless personal area network, a wireless local area network, a cellular network). The audio module 111 may provide any necessary audio control and optimization. For example, the integrated audio-visual system 100 may comprise an audio module 111 that control audio characteristics such as delay, equalization (EQ), compression, Q control, filtering, echo control, or room optimization. The audio signal received by the input receiver 110 may be driven, optimized, and segmented by the audio module 111. The audio module 111 may be implemented by the computing module illustrated in FIG. 4.

Still referring to FIG. 1, the diaphragm 101 may be made of different materials and comprise different driving mechanisms to convert audio signals into acoustic vibrations. In various embodiments, the diaphragm 101 may be made of integrated electromagnetic conductive materials capable of reproducing audio frequencies. For example, one or more voice coil circuits may be integrated into the diaphragm 101. In one embodiment, the diaphragm surface 102 may comprise a matrix of independent circuit wiring(s) woven into the projector screen material allowing zones or addressable areas across the surface material that can be independently driven with any number of unique sound channels or zones depending on spatial resolution required. In various embodiments, the integrated audio-visual system 100 may comprise one or more driving elements coupled to the input receiver. In response to an audio signal, the driving element(s) may force the voice coil(s) to move, resulting in vibration of the acoustic diaphragm 101. In one embodiment, the driving elements are made from magnetic materials.

In one embodiment, the diaphragm 101 may comprise a layer comprising one or more voice coils or voice coil circuits adhered to the image projection surface 102. In further embodiments, the diaphragm 101 may comprise a layer consisting of one or more voice coils or voice coil circuits sandwiched between two layers. These two layers may be the surfaces 102 and 103, respectively. These voice coil circuit(s) may create any number of audio zones or channels to create full fidelity sounds. Each audio zone may comprise one or more voice coils or voice coil circuits. In one embodiment, the integrated audio-visual system 100 comprises three audio zones or channels. The location and the area of each audio zone or channel may vary for diaphragms of different sizes that are made of different materials. In some embodiments, the diaphragm 101 is configured to perform optimally in the range from 80 Hz to 14 kHz, and the integrated audio-visual system 100 may comprise a lower frequency driver such as a subwoofer 112, or a high frequency driver such as a tweeter 113, a ribbon tweeter to enable a well-rounded full range sound quality.

In further embodiments, the diaphragm 101 may be made of nanomaterials. For example, graphene, carbon nanotubes, or other nano technology derived transducers that convert electrical signals either directly or via light (such as laser or light-emitting diodes (LEDs)) into acoustic waves. In one embodiment, graphene or carbon nanotubes are woven into a fabric, such as polyester fabric weave, cotton fabric weave, or similar textile suitable for both acoustic response and light reflectivity. The fabric needs to be tight enough to minimize stretch and also respond uniformly as an transducer. In one embodiment, graphene or carbon nanotubes are layered onto a substrate or fabric. The fabric may be transparent or semi-transparent, and may be treated or coated to reflect or diffuse light.

FIG. 1B is a rear view of an integrated audio-visual system. The diaphragm 101 of the integrated audio-visual system 100 is supported by the frame 104. In various embodiments, the frame 104 may be rigid. In the illustrated example, the diaphragm 101 comprises zones 120-122 and each diaphragm zone corresponds to an audio zone. The frame 104 may comprise various structures such as holes 125-127 to reduce wind resistance. Various diaphragm zones may have structures of different sizes.

Figure 2:
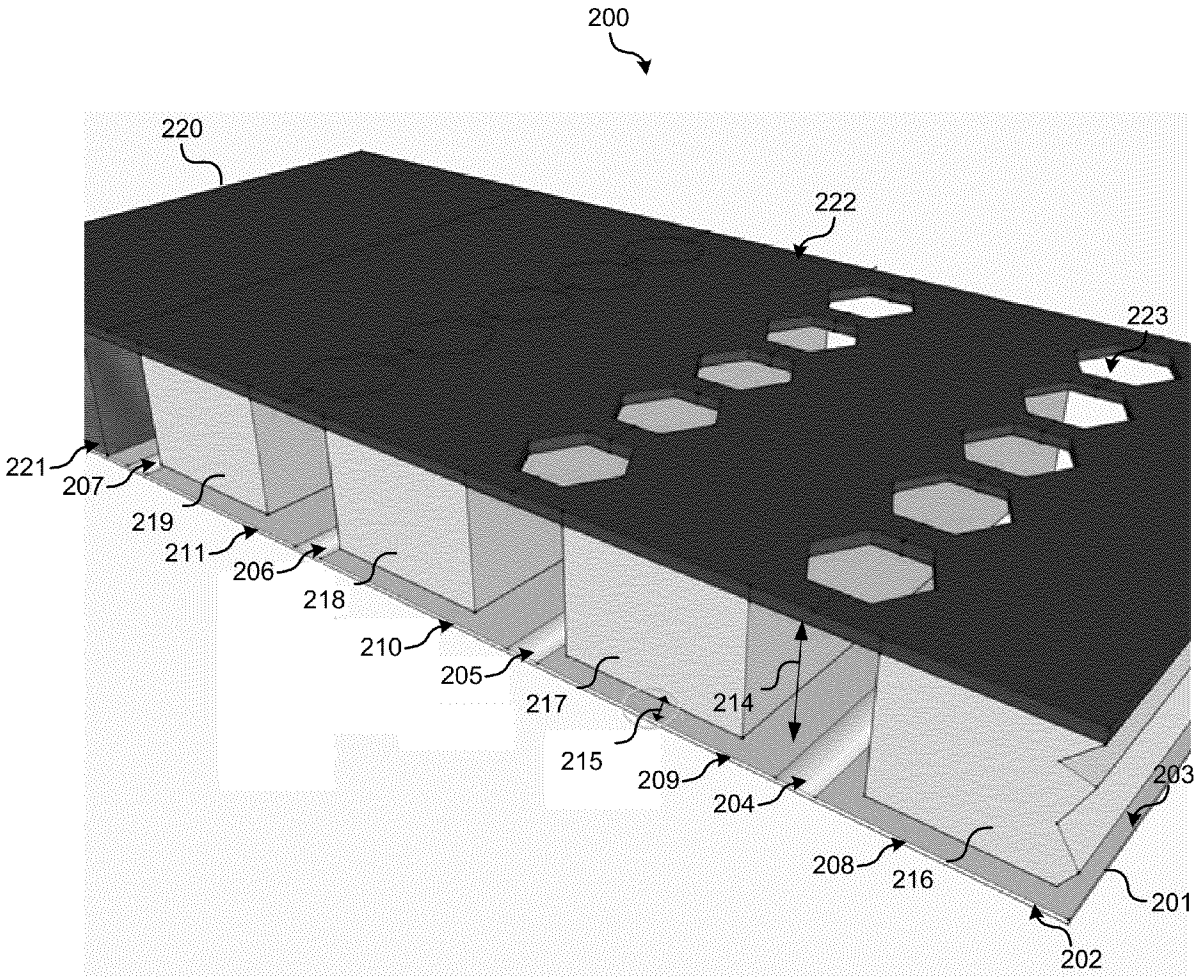
FIG. 2 is a sectional view of an integrated audio-visual system.

FIG. 2 is a sectional view of the integrated audio-visual system 200. In the illustrated example, the integrated audio-visual system 200 comprises a diaphragm 201, a frame 220, magnets 216-219, and an input receiver (not shown). The diaphragm 201 has a surface 202 that serves as the image projection screen and is capable of generating sound.

In the illustrated example, the diaphragm 201 comprises voice coil circuit(s) 204-207 that are coupled to the input receiver. The voice coil circuits 204-207 are integrated with the diaphragm 201. In one embodiment, the voice coil circuits may be sandwiched between the surface 202 and 203 of the diaphragm 201. In further embodiments, the voice coil circuits may be woven into the diaphragm material. In the illustrated example, the diaphragm 201 comprises sections 208-211. Each section may vibrate independently in response to an audio signal. In some embodiments, each section may correspond to an audio zone. In one embodiment, the diaphragm sections 208-211 are separate panels, which are integrated seamlessly to form a uniform surface 202 that serves as the image projection screen. Each diaphragm section may be a standard unit having multiple audio zones or channels.

The frame 220 is provided on the surface 203 of the diaphragm 201. The frame 220 and the diaphragm 201 define an air gap 214. In the illustrated example, the frame portion 221 that is directly coupled to the surface 203 of the diaphragm 201 is rigid. The rigid frame portion 221 prevents the diaphragm 201 from moving freely beyond a predetermined value to cause interference among various sound waves. Magnets 216-219 are coupled to the frame portion 222. Further, each magnet and the diaphragm 201 define an air gap 215. In one embodiment, the magnets 216-219 may be glued to the frame 220. In the illustrated example, the frame portion 222 may comprise one or more supporting structures 223. In the illustrated example, the supporting structures 223 are holes. The supporting structures support the magnets 216-219. In addition, the supporting structure(s) 223 also may also be configured to regulate air stiffness and to minimize the wind resistance and interference among sound waves. In other embodiments, the magnets may be coupled to the frame by other structures.

In the illustrated example, the driving unit of the integrated audio-visual system 200 may comprise the magnets 216-219 and the driving elements: the voice coil circuits 204-207. The voice coil circuits 204-207 may be coupled to an input receiver thereby to receive an audio signal. The voice coil circuits 204-207, in response to the audio signal, may generate an electromagnetic field that interacts with the electromagnetic fields of the magnets 216-219. Accordingly, the diaphragm 201 vibrates in response to the audio signal. As such, various portions of the diaphragm may be active generating sound waves in response to different sound signals.

A method of using various embodiments of the application as described herein is also provided. An audio signal may be provided to an integrated audio-visual system. Subsequently, the user may project images on the image projection screen of the integrated audio-visual system.

Figure 3:
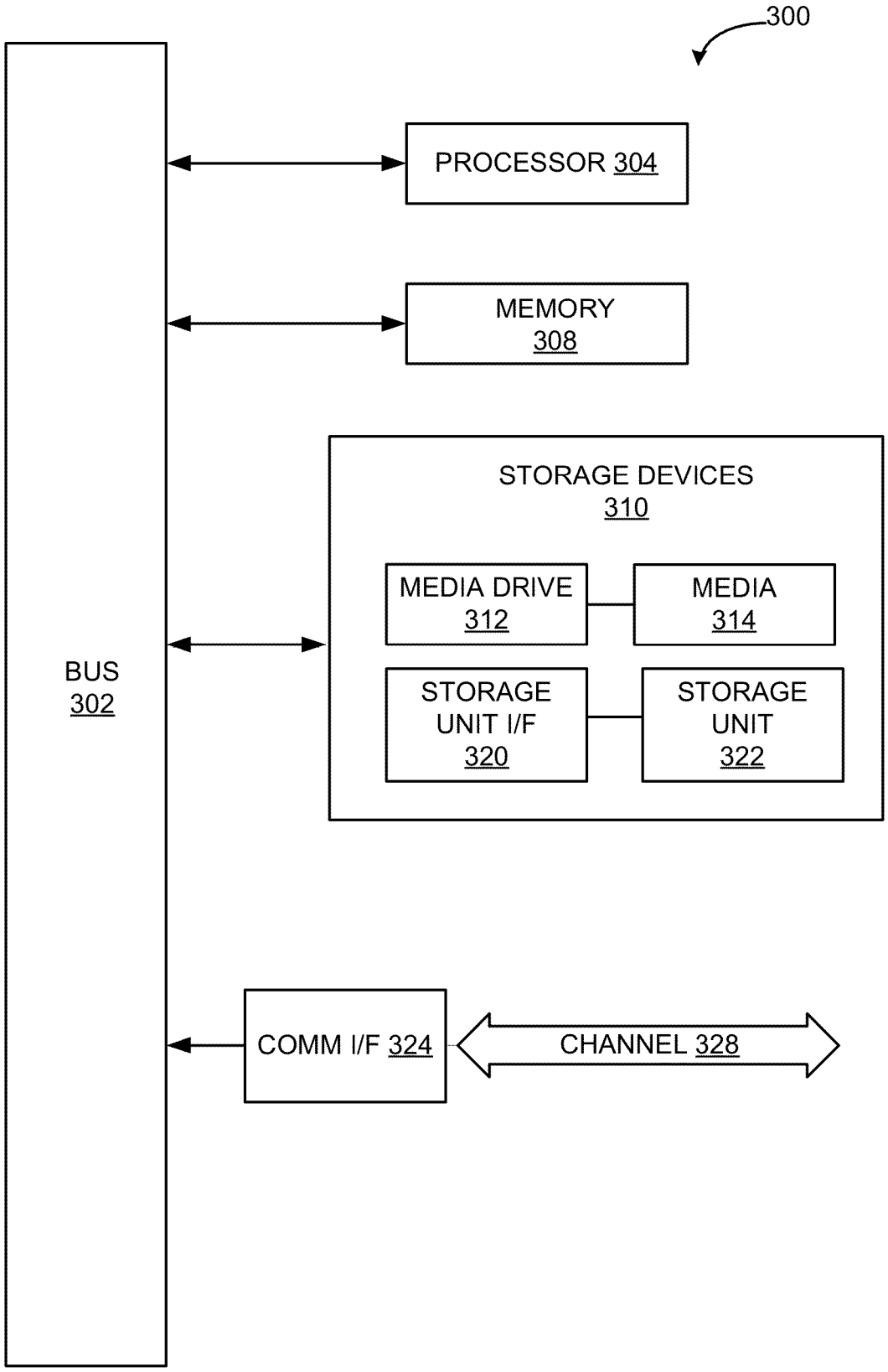
FIG. 3 illustrates an example computing module that may be used in implementing various features.

As used herein, the term module might describe a given unit of functionality that can be performed in accordance with one or more embodiments of the present application. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the application are implemented in whole or in part using software, in one embodiment, these software elements can be implemented to operate with a computing or processing module capable of carrying out the functionality described with respect thereto. One such example computing module is shown in FIG. 3. Various embodiments are described in terms of this example-computing module 300. After reading this description, it will become apparent to a person skilled in the relevant art how to implement the application using other computing modules or architectures.

Referring now to FIG. 3, computing module 300 may represent, for example, computing or processing capabilities found within desktop, laptop and notebook computers; hand-held computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 300 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 300 might include, for example, one or more processors, controllers, control modules, or other processing devices, such as a processor 304. Processor 304 might be implemented using a general-purpose or special-purpose processing engine such as, for example, a microprocessor, controller, or other control logic. In the illustrated example, processor 304 is connected to a bus 302, although any communication medium can be used to facilitate interaction with other components of computing module 300 or to communicate externally.

Computing module 300 might also include one or more memory modules, simply referred to herein as main memory 308. For example, preferably random access memory (RAM) or other dynamic memory, might be used for storing information and instructions to be executed by processor 304. Main memory 308 might also be used for storing temporary variables or other intermediate information during execution of instructions to be executed by processor 304. Computing module 300 might likewise include a read only memory ("ROM") or other static storage device coupled to bus 302 for storing static information and instructions for processor 304.

The computing module 300 might also include one or more various forms of information storage mechanism 310, which might include, for example, a media drive 312 and a storage unit interface 320. The media drive 312 might include a drive or other mechanism to support fixed or removable storage media 314. For example, a hard disk drive, a floppy disk drive, a magnetic tape drive, an optical disk drive, a CD or DVD drive (R or RW), or other removable or fixed media drive might be provided. Accordingly, storage media 314 might include, for example, a hard disk, a floppy disk, magnetic tape, cartridge, optical disk, a CD or DVD, or other fixed or removable medium that is read by, written to or accessed by media drive 312. As these examples illustrate, the storage media 314 can include a computer usable storage medium having stored therein computer software or data.

In alternative embodiments, information storage mechanism 310 might include other similar instrumentalities for allowing computer programs or other instructions or data to be loaded into computing module 300. Such instrumentalities might include, for example, a fixed or removable storage unit 322 and an interface 320. Examples of such storage units 322 and interfaces 320 can include a program cartridge and cartridge interface, a removable memory (for example, a flash memory or other removable memory module) and memory slot, a PCMCIA slot and card, and other fixed or removable storage units 322 and interfaces 320 that allow software and data to be transferred from the storage unit 322 to computing module 300.

Computing module 300 might also include a communications interface 324. Communications interface 324 might be used to allow software and data to be transferred between computing module 300 and external devices. Examples of communications interface 324 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 324 might typically be carried on signals, which can be electronic, electromagnetic (which includes optical) or other signals capable of being exchanged by a given communications interface 324. These signals might be provided to communications interface 324 via a channel 328. This channel 328 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 308, storage unit 320, media 314, and channel 328. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 300 to perform features or functions of the present application as discussed herein.

While various embodiments of the present application have been described above, it should be understood that they have been presented by way of example only, and not of limitation. Likewise, the various diagrams may depict an example architectural or other configuration for the application, which is done to aid in understanding the features and functionality that can be included in the application. The application is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present application. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the application is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the application, whether or not such embodiments are described and whether or not such features are presented as being a part of a described embodiment. Thus, the breadth and scope of the present application should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An integrated audio-visual system comprising:

an acoustic diaphragm configured to vibrate in response to an audio signal and having a first surface and a second surface, the first surface serving as an image projection screen for theaters and location-based venues;

an input terminal coupled to the acoustic diaphragm and configured to receive the audio signal;

a frame provided on the second surface of the acoustic diaphragm, wherein the frame defines a first air gap and exposes a portion of the second surface of the acoustic diaphragm to the first air gap; and a set of magnets, wherein the set of magnets are mounted to the frame and define a second air gap between the set of magnets and the second surface.

2. The integrated audio-visual system of claim 1 further comprising a driving unit comprising a driving element, wherein the input terminal is coupled to the driving element.

3. The integrated audio-visual system of claim 1, wherein the acoustic diaphragm comprises a plurality of diaphragm sections, each of the plurality of sections vibrating independently.

4. The integrated audio-visual system of claim 1, wherein the first surface comprises a woven matrix of independent circuit wirings.

5. The integrated audio-visual system of claim 1 further comprising an audio processing module controlling audio characteristics, the audio processing module coupled to the input terminal.

6. The integrated audio-visual system of claim 1, wherein the image projection screen displays 3-D images.

7. The integrated audio-visual system of claim 1, wherein the acoustic diaphragm comprises:

a voice coil layer comprising a plurality of voice coils;

a first layer, the first layer formed on a first side of the plurality of voice coils and serves as the image projection screen for theaters or location-based venues.

8. The integrated audio-visual system of claim 7, wherein the acoustic diaphragm further comprises:

a second layer, the second layer formed on a second side of the plurality of voice coils;

wherein the plurality of voice coils are sandwiched between the first layer and the second layer.

9. The integrated audio-visual system of claim 1, wherein the acoustic diaphragm is configured to comprise a set of audio zones.

10. The integrated audio-visual system of claim 1, wherein the acoustic diaphragm comprises a graphene sheet.

11. The integrated audio-visual system of claim 1, wherein the acoustic diaphragm comprises a carbon nanotube sheet.

12. A method of using an integrated audio-visual system, comprising providing an audio signal to the integrated audio-visual system; and projecting an image on an image projection screen for theaters or location-based venues, wherein the integrated audio-visual comprises:

an acoustic diaphragm configured to vibrate in response to the audio signal and having a first surface and a second surface, the first surface serving as the image projection screen for theaters or location-based venues;

an input terminal coupled to the acoustic diaphragm and configured to receive the audio signal;

a frame provided on the second surface of the acoustic diaphragm, the frame defining a first air gap and exposing a portion of the second surface of the acoustic diaphragm to the first air gap; and a set of magnets, wherein the set of magnets are mounted to the frame and define a second air gap between the set of magnets and the second surface.

13. The method of claim 12, wherein the integrated audio-visual system further comprises a driving unit comprising a driving element, wherein the input terminal is coupled to the driving element.

14. The method of claim 12, wherein the acoustic diaphragm comprises a plurality of diaphragm sections, each of the plurality of sections vibrating independently.

15. The method of claim 12, wherein the first surface comprises a woven matrix of independent circuit wirings.

16. The method of claim 12, wherein the acoustic diaphragm comprises:

a voice coil layer comprising a plurality of voice coils;

a first layer, the first layer formed on a first side of the plurality of voice coils and serves as the image projection section for theaters or location-based venues.

17. The method of claim 16, wherein acoustic diaphragm further comprises:

a second layer, the second layer formed on a second side of the plurality of voice coils;

wherein the plurality of voice coils are sandwiched between the first layer and the second layer.

* * * * *